US006926497B2

(12) United States Patent
Lin et al.

(10) Patent No.: US 6,926,497 B2
(45) Date of Patent: Aug. 9, 2005

(54) FAN HOUSING ASSEMBLY

(75) Inventors: Kuo-cheng Lin, Taoyuan (TW); Wen-shi Huang, Taoyuan (TW)

(73) Assignee: Delta Electronics, Inc., Taoyuan (TW)

( * ) Notice: Subject to any disclaimer, the term of this patent is extended or adjusted under 35 U.S.C. 154(b) by 47 days.

(21) Appl. No.: 10/651,825

(22) Filed: Aug. 29, 2003

(65) Prior Publication Data

US 2004/0141840 A1 Jul. 22, 2004

(30) Foreign Application Priority Data

Jan. 21, 2003 (TW) ..... 92201118 U

(51) Int. Cl.[7] ..... F04D 29/60

(52) U.S. Cl. ..... 415/213.1; 415/214.1; 415/229; 416/244 R

(58) Field of Search ..... 415/121.2, 200, 415/214.1, 215.1, 216.1, 229, 213.1; 416/244 R, 247 R

(56) References Cited

U.S. PATENT DOCUMENTS

| | | | | | |
|---|---|---|---|---|---|
| 3,376,057 | A | * | 4/1968 | Van Buren, Jr. | 403/197 |
| 5,245,236 | A | * | 9/1993 | Horng | 310/67 R |
| 6,244,818 | B1 | * | 6/2001 | Chang | 415/208.2 |
| 6,421,239 | B1 | * | 7/2002 | Huang | 361/696 |

* cited by examiner

*Primary Examiner*—Edward K. Look
*Assistant Examiner*—Dwayne J. White
(74) *Attorney, Agent, or Firm*—Pai Patent & Trademark Law Firm; Chao-Chang David Pai

(57) ABSTRACT

A fan housing assembly includes a mounting base formed with a through hole thereon and a bushing. The bushing has a sleeve and is coupled to the mounting base by connecting the sleeve to the through hole. The mounting base and the bushing can be separately formed with predetermined materials in view of the different quality requirements before being assembled, thus resulting in lower manufacturing cost and enhanced flexibility in the fan design.

18 Claims, 6 Drawing Sheets

FAN HOUSING ASSEMBLY

BACKGROUND OF THE INVENTION (a) Field of the Invention

The invention relates to a fan housing assembly and, more particularly, to a fan housing assembly whose different parts are separately formed in view of different quality requirements.

(b) Description of the Related Art

FIG. 1 is a cross-sectional view of a conventional one-piece molding fan housing design. Referring to FIG. 1, the housing 100 includes an outer frame 102, a flange 104, ribs 106 and a bearing tube 108, and all of these parts constituting the one-piece housing 100 are made of the same material by way of injection molding.

However, one-piece injection molding utilized in the formation of the housing 100 suffers from the following disadvantages. First, because the bearing tube 108 located between a bearing and a stator of a motor (not shown) is to position and support the bearing of a fan, the fabrication of the bearing tube 108 requires high precision. Also, because the heat generated from the motor is directly conducted to the bearing tube 108, the material selected for the bearing tube 108 must meet high heat-resistance requirement. However, it is not necessary for other parts of the housing 100 such as the outer frame 102, flange 104 and ribs 106 to meet such high-quality requirements. When the conventional one-piece molding is utilized to fabricate the fan housing, all parts constituting the housing 100 are forced to adopt the same high-quality material so as to meet the quality requirement of the bearing tube 108, thus resulting in a considerable manufacturing cost.

Moreover, the conventional one-piece molding fabrication does not allow the selection of materials for different parts of the housing in view of the specific requirements. For example, it is impossible to fabricate a fan housing whose bearing tube 108 is made of metal to enhance the strength or meet other requirements while other parts are made of plastic, if the conventional one-piece molding fabrication is utilized. Furthermore, when a fan is used in different systems, it is difficult, if the conventional one-piece molding fabrication is utilized, to adapt the design of the fan housing to fit different systems. This significantly reduces the flexibility of a fan housing design.

BRIEF SUMMARY OF THE INVENTION

It is therefore an objective of the invention to provide a fan housing assembly whose required parts are separately formed in view of different quality requirements so as to reduce the manufacturing cost and enhance the flexibility of the fan design.

To achieve the above-mentioned objective, the fan housing assembly according to the invention includes a mounting base and a bushing that are separately formed in advance before being assembled. In one embodiment, the mounting base is a fan frame, and the mounting base is provided with a through hole in its central location. The mounting base is made of ordinary polystyrene plastics, and the bushing is made of polyester plastics, and they are separately formed in advance before being fused together by way of ultrasonic welding.

In another embodiment of the invention, the bushing is made of primary material of plastics, and the mounting base is made of secondary material of plastics.

Further, the bushing and the mounting base may be assembled by way of ultrasonic welding, screwing, engaging or adhering. Preferably, the way that the bushing couples with the mounting base depends on the selection of the materials.

Through the invention, since the bushing and the mounting base are separately formed in advance before being assembled, different parts of the housing can be made of different materials in view of different quality requirements, such as the fabrication precision or heat duration, thus significantly reducing the manufacturing cost.

Also, the two-piece molding according to the invention makes it possible for different parts of the housing to be made of different materials in view of the specific requirements. For example, the bushing can be made of metal such as copper or aluminum while the mounting base made of plastic, thus making the fan housing design more flexible.

According to the invention, because the bushing and the mounting base are separately formed, one part of any system that needs to incorporate a fan therein for dissipating heat can function as the mounting base, thus eliminating the need of a separate fan frame in a conventional design. Hence, the manufacturing cost can be reduced, and the new flow field generated by the fan design without the fan frame can enhance the heat dissipation.

Also, the through hole can be directly formed on a housing of a system that needs to incorporate a fan therein. In that case, a sidewall of a system, such as a power supply, can function as the mounting base to be coupled with the bushing, thus further reducing the number of components and simplifying the manufacturing process.

It should be noted that according to the invention, when the bushing and the mounting base are separately formed, the mounting base is not limited to a fan guard or a system housing, but can be any part of the system that incorporates a fan. The system includes, but is not limited to, a power supply, a server or a computer; in fact, any system that needs to incorporate a fan for dissipating heat can be utilized in the invention.

DETAILED DESCRIPTION OF THE INVENTION

Figure 1:
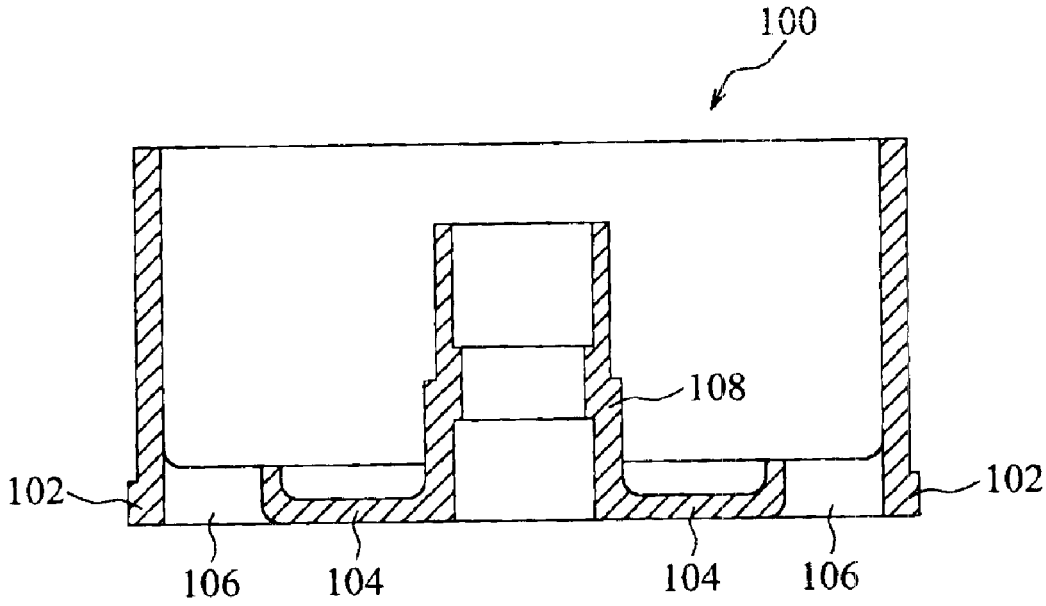
FIG. 1 (PRIOR ART)
FIG. 1 is a cross-sectional view of a conventional one-piece molding fan housing design.
Figure 2:
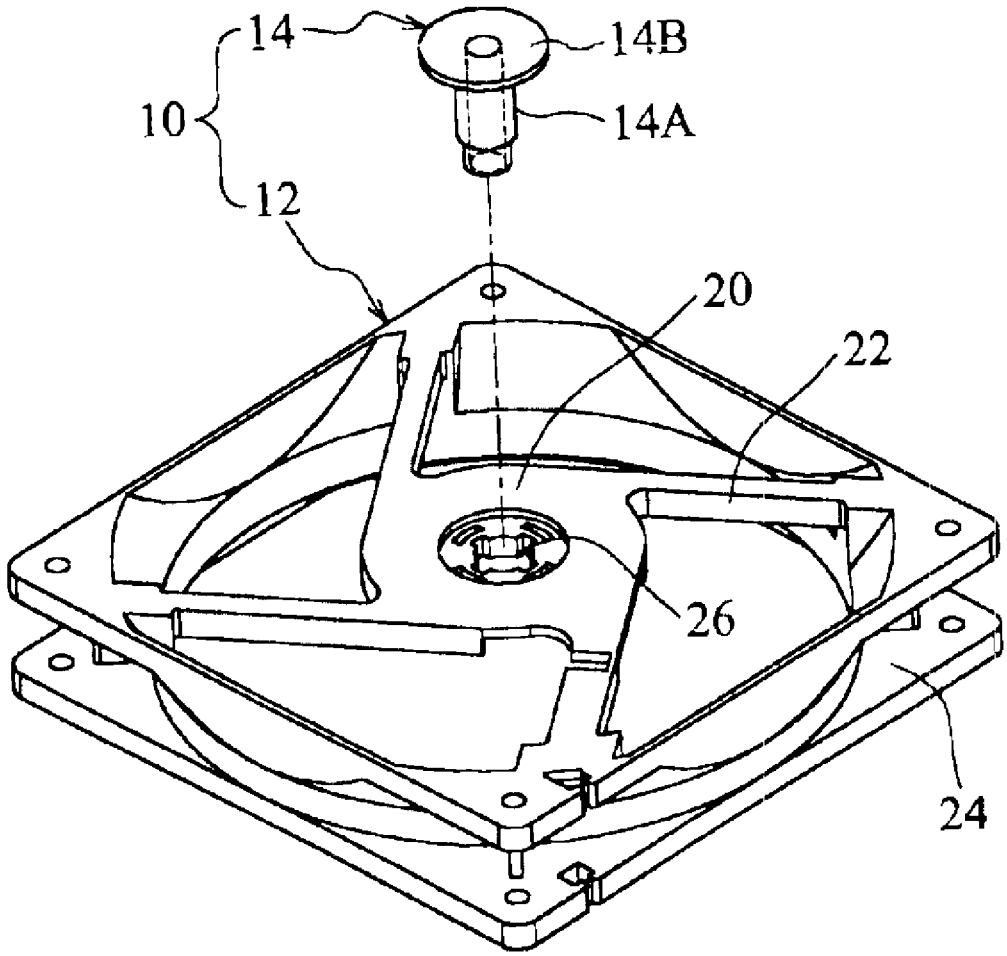
FIG. 2 is an exploded view of a housing assembly according to an embodiment of the invention.

FIG. 2 is an exploded view of a housing assembly 10 according to an embodiment of the invention. As shown in FIG. 2, the fan housing assembly 10 includes a mounting base 12 and a bushing 14. The mounting base 12 includes a flange 20, ribs 22 and a frame 24, and the flange 20 is provided with a through hole 26 in its central location. The bushing 14 is substantially cylindrical, and has a sleeve 14A and a bottom portion 14B. During assembly, the bushing 14 is inserted into the through hole 26 of the flange 20 so that the bottom portion 14B is attached to the sidewall near the through hole 26.

Figure 3:
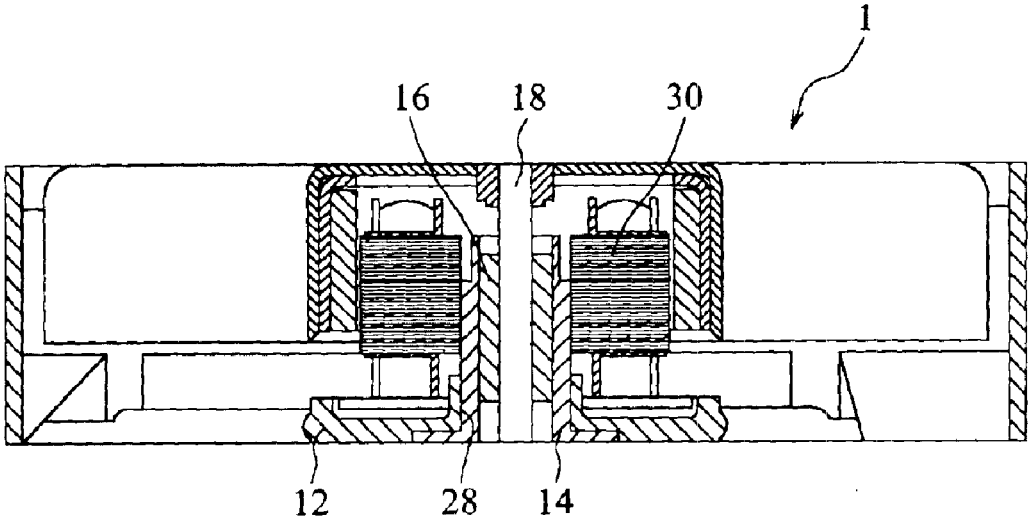
FIG. 3 is a cross-sectional view of a fan motor showing the connection relationship between the mounting base, the bushing and other components.

FIG. 3 is a cross-sectional view of a fan motor 1 showing the connection relationship between the mounting base 12, the bushing 14 and other components.

In this embodiment, the mounting base 12 and the bushing 14 are separately formed in advance before being assembled. The bushing 14 can be made of engineering plastics, such as polybutylene terephthalate (PBT) or polyethylene terephthalate (PET). On the other hand, the mounting base 12 can be made of ordinary plastics, such as acrylonitrile butadiene styrene (ABS). When the bottom portion 14B is attached to the sidewall of the flange 20 near the through hole 26, an ultrasonic plastic welder (not shown) conducts ultrasound to the interface 28 between the mounting base 12 and the bushing 14 to perform ultrasonic welding. Thereby, the bushing 14 can immediately fuse with the mounting base 12.

According to the embodiment, because the bushing 14 and the mounting base 12 are separately formed before being fused together, different materials can be used to form the bushing 14 and the mounting base 12 in view of distinct quality requirements. More specifically, as shown in FIG. 3, since a bearing 16 is provided inside the sleeve 14A of the bushing 14 to position the shaft 18, the fabrication of the bushing 14 requires high precision. Further, the heat generated from the coil 30 of the motor is directly conducted to the bushing 14, so the material selected for the bushing 14 must meet the high heat-resistance requirement to minimize the dimensional change or distortion due to temperature variation. However, it is not necessary for the flange 20, the ribs 22 and the frame 24 to have such quality requirements. Therefore, since the bushing 14 and the mounting base 12 are separately formed in advance before being fused together, the bushing 14 can be made of engineering plastics in view of the aforesaid quality requirements while the mounting base 12 can be made of ordinary plastics, thus significantly reducing the manufacturing cost.

Moreover, such a two-piece forming can further reserve the clearance between the mounting base 12 and the bushing 14 to offset thermal expansion of materials due to temperature variation. Thus, the disadvantage of one-piece molding fabrication that the fan housing easily cracks due to non-uniform distribution of the thermal stress can be avoided.

According to another embodiment of the invention, the bushing 14 is made of primary material of plastics while the mounting base 12 is made of secondary material of plastics. Generally speaking, it is hard to control the injection molding parameters of the secondary material of plastics because its quality has already deteriorated, and thus the fabrication precision and the heat duration quality cannot be ensured. However, the secondary material of plastics are suitable for molding the mounting base 12 because the material constituting the mounting base 12 does not require high quality. In this embodiment, the bushing 14 can be molded from primary material of plastics first, and then the mounting base 12 with lower quality requirements can be molded from secondary material of plastics that have been put through injection molding once. Hence, the objective of reducing manufacturing cost can also be achieved.

The two-piece molding according to the invention makes it possible for different parts of the housing to be made of different materials in view of specific requirements, thus making the fan housing design more flexible. For example, the bushing 14 can be made of metal such as copper or aluminum while the mounting base 12 can be made of plastic. The metallic bushing 14 can be inserted into the plastic mounting base 12, and then they are fused together by ultrasonic welding. Alternatively, the mounting base 12 can be made of metal while the bushing 14 made of plastic, if needed.

Figure 4:
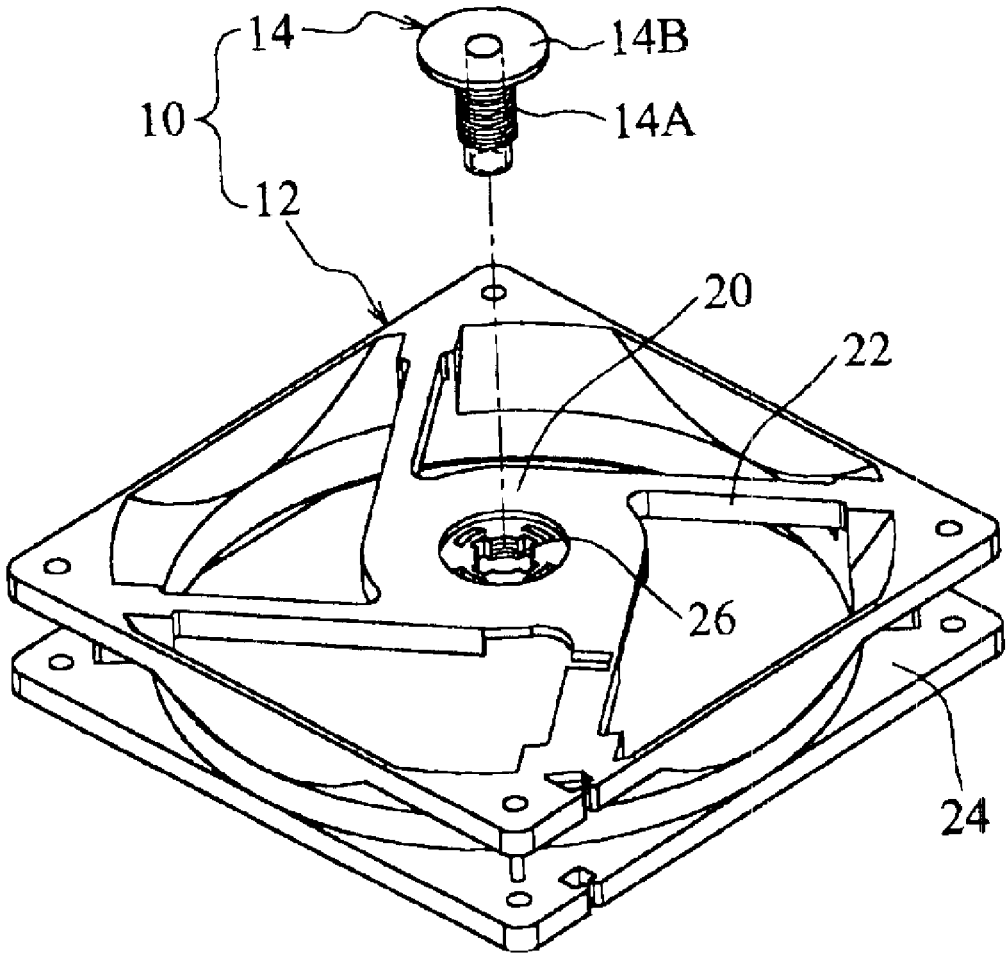
FIG. 4 is an exploded view of an example of the combination of the bushing and the mounting base.

Further, the way of coupling the mounting base 12 and the bushing 14 is not limited to ultrasonic welding. For example, as shown in FIG. 4, the bushing 14 and the flange 20 can be provided with the corresponding threads, so the bushing 14 and the mounting base 12 can be coupled by screwing. Also, the bushing 14 can be formed in the shape of a clasp to be directly fastened to the mounting base 12, or the bushing 14 can be fixed to the mounting base 12 by way of adhesion. Preferably, the way that the bushing 14 couples with the mounting base 12 depends on the selection of the materials.

Through the invention, when such a design is applied in a system that needs to incorporate a fan for dissipating heat, the way that different parts of the housing are separately formed in advance before being assembled can enhance the flexibility of the fan design since the separately formed parts of the housing assembly can be modified in view of the configuration of the system. The aforesaid advantage of the invention will be described herein below with reference to FIG. 5 and FIG. 6.

Figure 5:
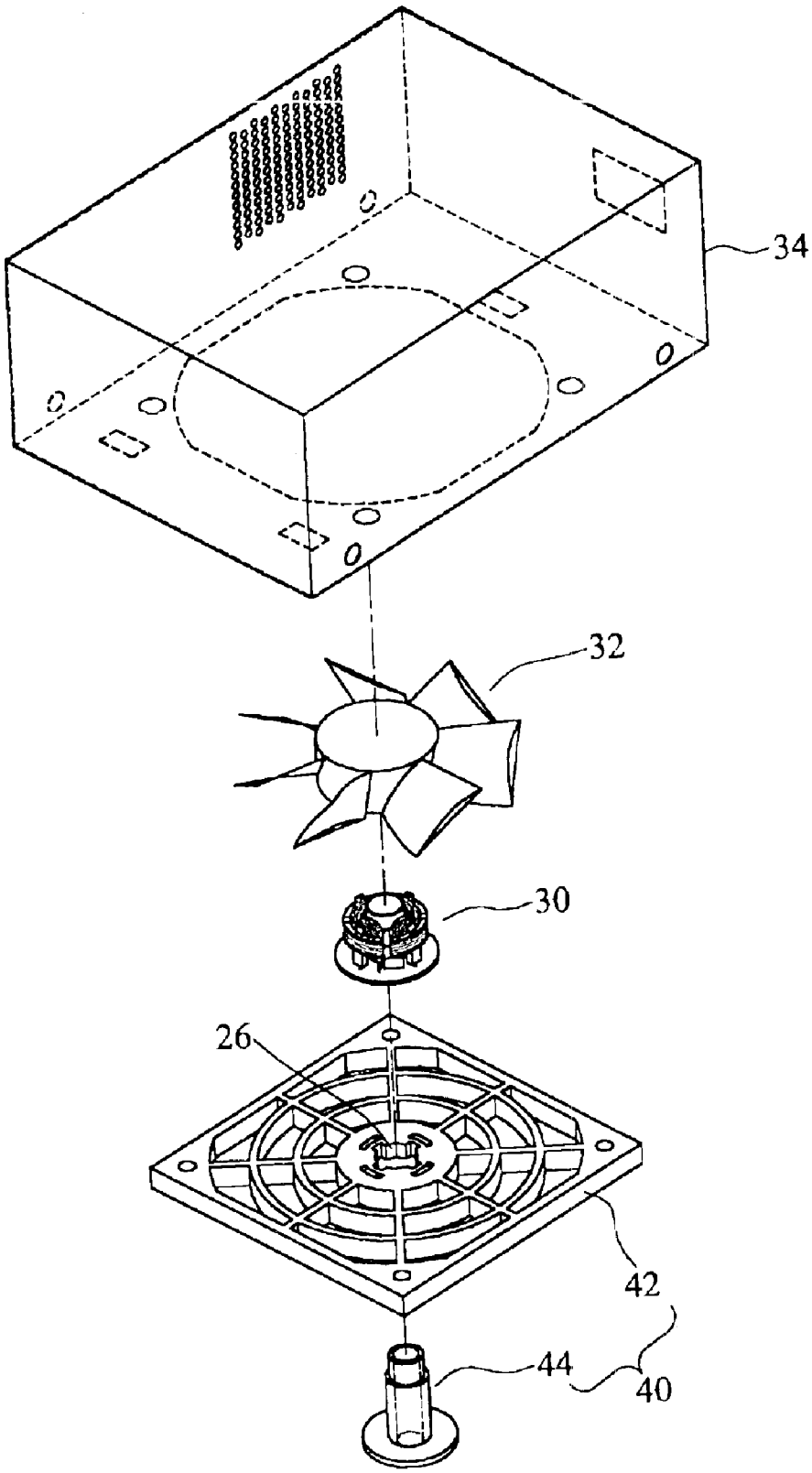
FIG. 5 is an exploded view of a fan housing assembly incorporated in a power supply according to another embodiment of the invention.

FIG. 5 is an exploded view of a fan housing assembly incorporated in a power supply according to another embodiment of the invention. Referring to FIG. 5, a fan guard 42 of a power supply can function as a mounting base of a fan housing assembly 40, with a through hole 26 formed in the central location of the fan guard 42. A bushing 44 is coupled with the fan guard 42 via the through hole 26, and then they join the stator 30 and the rotor 32 together, thus completing a fan housing assembly installed on a power supply.

Therefore, according to the invention, because the bushing and the mounting base are separately formed, one part of the system (such as the fan guard of the power supply) can function as the mounting base, thus eliminating the need of a separate fan frame in a conventional design. Hence, the manufacturing cost can be reduced, and the new flow field generated by the fan design without the fan frame can enhance the heat dissipation.

Figure 6:
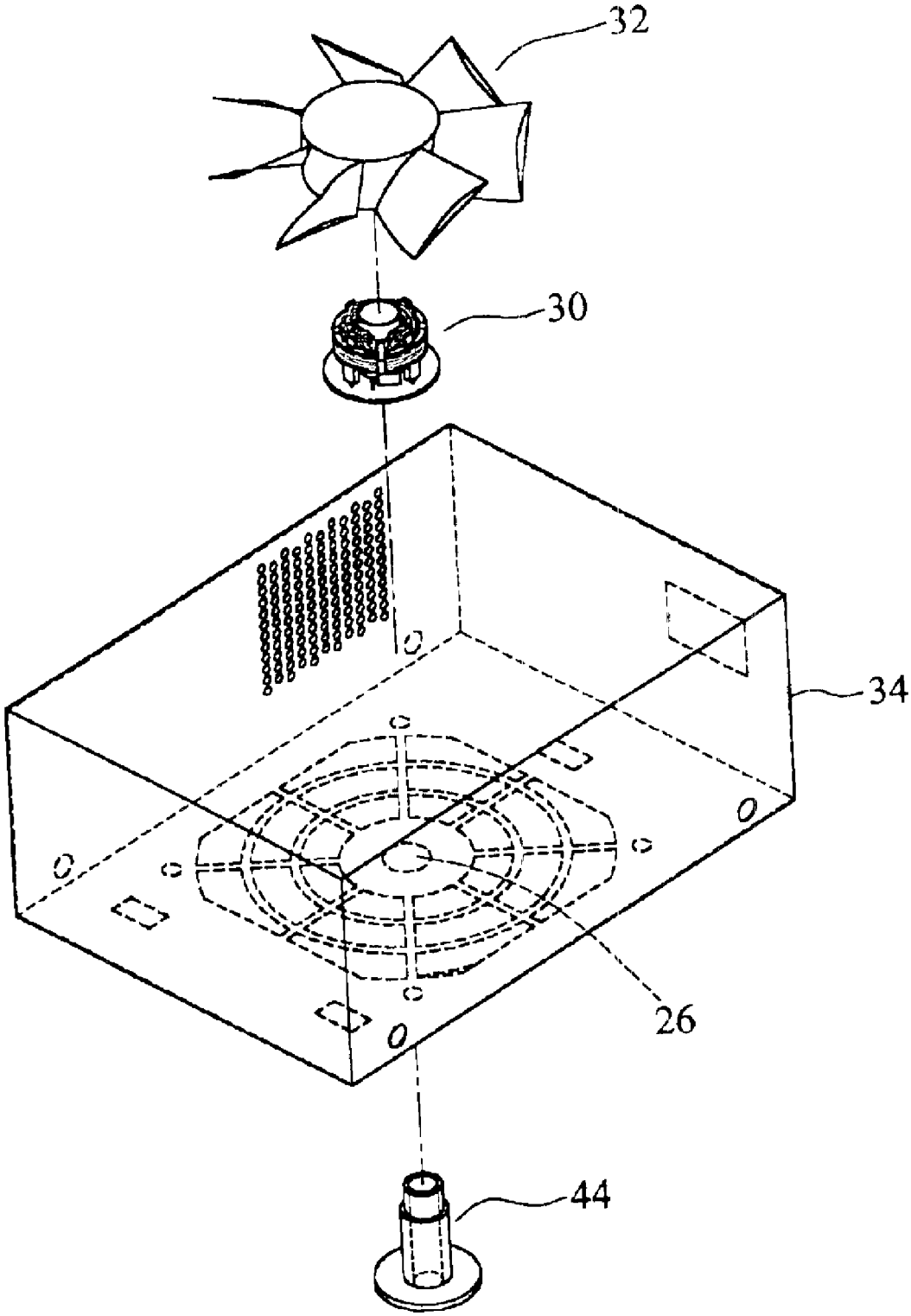
FIG. 6 is an exploded view of a fan housing assembly incorporated in a power supply according to still another embodiment of the invention.

FIG. 6 is an exploded view of a fan housing assembly incorporated in a power supply according to still another embodiment of the invention.

Referring to FIG. 6, the through hole 26 can be directly formed on a housing 34 of a power supply. In that case, a sidewall of the power supply housing 34 can function as the mounting base to couple with the bushing 44, which combines the stator 30 and rotor 32 to complete the installation of the fan housing assembly in a power supply. Through the design, the number of components can be further reduced, and the manufacturing process further simplified.

It should be noted that according to the invention, when the bushing and the mounting base are separately formed, the mounting base is not limited to a fan guard or a system housing, but can be any part of the system that incorporates a fan. The system includes, but is not limited to, a power supply, a server or a computer; in fact, any system that needs to incorporate a fan for dissipating heat can be utilized in the invention.

While the invention has been described by way of examples and in terms of the preferred embodiments, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A fan housing assembly comprising:

a mounting base; and a bushing coupled to the mounting base, wherein the bushing comprises a sleeve and a bottom portion, and the bushing is coupled to the mounting base by attaching the bottom portion to the mounting base;

wherein the mounting base and the bushing are separately formed with predetermined materials before being assembled.

2. The fan housing assembly according to claim 1, wherein the mounting base is made of ordinary plastics, and the bushing is made of engineering plastics.

3. The fan housing assembly according to claim 2, wherein the ordinary plastic is polystyrene plastic.

4. The fan housing assembly according to claim 2, wherein the engineering plastics is polyester plastics.

5. The fan housing assembly according to claim 1, wherein the bushing is made of primary material of plastics and the mounting base is made of secondary material of plastics.

6. The fan housing assembly according to claim 1, wherein the bushing is made of metal.

7. The fan housing assembly according to claim 1, wherein the mounting base is made of metal.

8. The fan housing assembly according to claim 1, wherein the bushing is coupled to the mounting base by ultrasonic welding.

9. The fan housing assembly according to claim 1, wherein the bushing is coupled to the mounting base by engagement.

10. The fan housing assembly according to claim 1, wherein the bushing is screwed to the mounting base.

11. The fan housing assembly according to claim 1, wherein the bushing is coupled to the mounting base by adhesion.

12. The fan housing assembly according to claim 1, wherein the mounting base is a fan frame.

13. The fan housing assembly according to claim 12, wherein the fan frame comprises a flange, and a through hole is formed in a central location of the flange.

14. The fan housing assembly according to claim 1, wherein the mounting base is a frame of a device that incorporates a fan assembly therein.

15. The fan housing assembly according to claim 14, wherein the device that incorporates the fan assembly therein is a power supply, a server or a computer.

16. The fan housing assembly according to claim 1, wherein the mounting base is a sidewall of a device housing.

17. The fan housing assembly according to claim 1, wherein the mounting base is a fan guard.

18. The fan housing assembly according to claim 1, wherein the mounting base includes a through hole and the bottom portion of the bushing is attached to the mounting base after the sleeve passes through the through hole.

* * * * *